United States Patent [19]

Hu

[11] Patent Number: 4,921,574

[45] Date of Patent: May 1, 1990

[54] PROCESS FOR CONTROLLING PROPERTIES OF TRAVELLING SHEETS WITH SCAN WIDTHS LESS THAN THE SHEET WIDTH

[75] Inventor: Hung-Tzaw Hu, Cupertino, Calif.

[73] Assignee: Measurex Corporation, Cupertino, Calif.

[21] Appl. No.: 303,478

[22] Filed: Jan. 27, 1989

[51] Int. Cl.[5] ..... D21F 1/06; D21F 7/06

[52] U.S. Cl. ..... 162/198; 162/252; 162/263

[58] Field of Search ..... 162/198, 252, 253, 258, 162/259, 263, DIG. 6, DIG. 11; 364/471; 73/159

[56] References Cited

U.S. PATENT DOCUMENTS 3,678,594 7/1972 Goerz, Jr. et al. ..... 162/253

3,936,665 2/1976 Donoghue ..... 162/252

FOREIGN PATENT DOCUMENTS 863743 9/1981 U.S.S.R. ..... 162/252

*Primary Examiner*—Karen M. Hastings

*Attorney, Agent, or Firm*—Burns, Doane, Swecker & Mathis

[57] ABSTRACT

A method for controlling high-speed sheetmaking machine after abrupt process changes and during start-up periods, includes operating a scanning sensor to periodically traverse back and forth across a sheet in the cross direction to detect values of selected sheet property along each scan while the cross-directional width of each scan is controlled to be substantially less than the width of the sheet being scanned, the progressively increasing the width of the scan until each scan encompasses the full width of the moving sheet.

7 Claims, 2 Drawing Sheets

PROCESS FOR CONTROLLING PROPERTIES OF TRAVELLING SHEETS WITH SCAN WIDTHS LESS THAN THE SHEET WIDTH

BACKGROUND OF THE INVENTION

1. Field of the Invention

The present invention generally relates to sheetmaking control systems and, more particularly, to sheetmaking control systems wherein measuring devices scan across travelling sheets.

2. State of the Art

It is well known that on-line measurements can be made to detect properties of sheet materials during manufacture. Generally speaking, on-line measurements are made to enable prompt control of sheetmaking processes and, thus, to assure sheet quality while reducing the quantity of substandard sheet material which is produced before process upset conditions are corrected. In the papermaking art, for instance, on-line sensors can detect variables such as basis weight, moisture content, and caliper of paper sheets during manufacture.

One of the main complications in making on-line measurements during sheetmaking is that the physical properties of sheet materials usually vary in the machine direction as well as in the cross direction. (In the sheetmaking art, the term "machine direction" refers to the direction of travel of sheet material during manufacture, and the term "cross direction" refers to the direction across the surface of a sheet perpendicular to the machine direction.)

To detect variations in sheet materials, it is well known to use scanning sensors that periodically traverse back and forth across a sheetmaking machine in the cross direction while detecting values of a selected sheet property along each scan. Normally, the sheet being produced is traversed from edge to edge during each scan. The time required for a typical scan is generally between about twenty and thirty seconds for conventional scanners. The rate at which measurement readings are provided by such scanners is usually adjustable; a typical rate is about one measurement reading every fifty milliseconds.

In practice, measurement information provided by scanning sensors is usually assembled after each scan to provide a "profile" of the detected sheet property in the cross direction. In other words, each profile is comprised of a succession of sheet measurements at adjacent locations in the cross direction. The purpose of the profiles is to allow cross-directional variations in sheet properties to be detected easily. Based upon the detected cross-directional variations in the detected sheet property, appropriate control adjustments may be made to the sheetmaking machine with the goal of reducing profiles variations both in the cross direction and in the machine direction.

Although modern sheetmaking control systems provide substantial advantages, there are some shortcomings. One shortcoming of conventional systems is that their response times are relatively slow, especially following abrupt change in process conditions such as caused by sheet breaks or real changes, or during start-up. The slow response times of the control systems, although necessary to assure control stability, often allow substantial quantities of substandard sheet material to be produced before effective corrective actions are implemented. Thus, it can be appreciated that there is a need for control systems that rapidly adjust sheetmaking machines when process conditions change abruptly but, under normal conditions, provide smooth operation.

SUMMARY OF THE INVENTION

Generally speaking, the present invention provides a method for controlling high-speed sheetmaking machine after abrupt process changes and during start-up periods and the like. In the preferred embodiment, the method comprises operating a scanning sensor to periodically traverse back and forth across a sheet in the cross direction to detect values of a selected sheet property along each scan while controlling the cross-directional width of each scan to be substantially less than the width of the sheet getting scanned.

BRIEF DESCRIPTION OF THE DRAWINGS

The present invention can be further understood by reference to the following description and attached drawings which illustrate the preferred embodiment. In the drawings.

DETAILED DESCRIPTION OF THE PREFERRED EMBODIMENT

Figure 1:
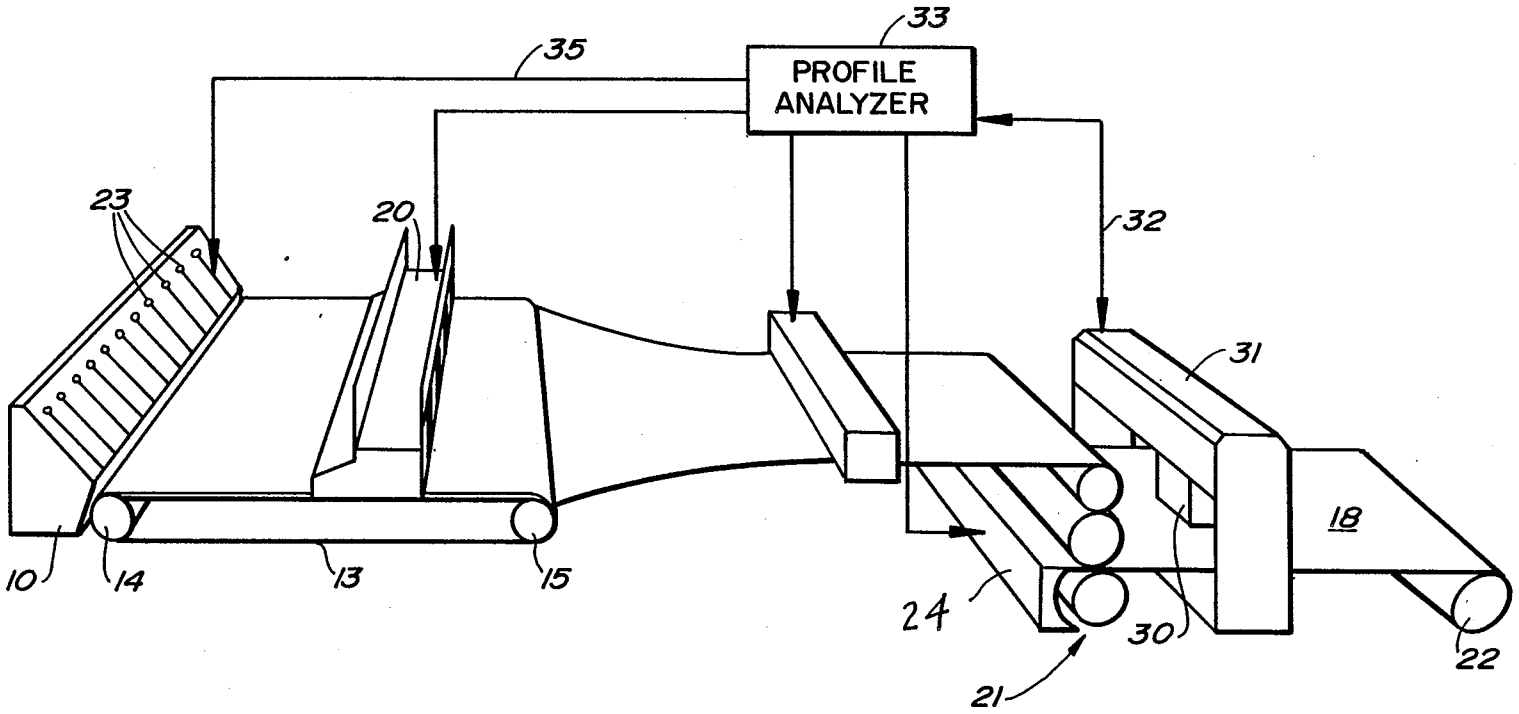
FIG. 1 is a pictorial view which schematically shows an example of a conventional sheetmaking machine.

FIG. 1 shows an example of a conventional machine for producing continuous sheets of material such as paper. In the illustrated embodiment, the sheetmaking machine includes a feed box 10 which discharges raw material, such as paper pulp, onto a supporting web 13 trained between rollers 14 and 15. Further, the sheetmaking machine includes various processing stages, such as a calendering stack 21, which operate upon the raw material to produce a finished sheet 18 which is collected onto a reel 22.

In conventional sheetmaking practice, the processing stages along the machine of FIG. 1 each include profile actuators for controlling the properties of sheet 18 at adjacent cross-directional locations, normally referred to as "slices." Thus, for example, calendering stack 21 includes actuators 24 for controlling the compressive pressure applied to sheet 18 at various slice locations. The actuators normally are independently adjustable.

To provide control information for operating the profile actuators at the various processing stages on the sheetmaking machine of FIG. 1, at least one scanning sensor 30 is provided. In the illustrated embodiment, scanning sensor 30 is mounted on a supporting frame 31 that extends across the sheetmaking machine in the cross direction. Further, scanning sensor 30 is connected, as by line 32, to a profile analyzer 33 to provide the analyzer with signals indicative of the magnitude of the measured sheet property (e.g., caliper) at various cross-directional measurement points. In turn, profile analyzer 33 is connected to control the profile actuators at the various processing stages. For example, line 32 carries control signals from profile analyzer 33 to the actuators 24 calender stack 21.

It should be understood that profile analyze 33 is a signal processor which include a control system which operates in response to the cross-directional measurements. One example of such an analyzer is the Mini- Slice (TM) processor available from Measurex Corporation of Cupertino, California. It should also be understood that the analyzer includes means to control operation of scanning sensor 30. Typically the scanning sensor is controlled to travel at a rate of about twelve inches per second, although the rate is adjustable.

In normal operation of the system of FIG. 1, scanning sensor 30 periodically traverses sheet 18 at generally constant speed. However, scanning sensor 30 does not measure the selected sheet property at locations which are aligned exactly perpendicular to the longitudinal edges of the sheet. Instead, because of the sheet velocity, scanning sensors actually travel diagonally across the sheet surface, with the result that consecutive scanning paths have a zig-zag pattern with respect to the direction perpendicular to the longitudinal edges of sheet 18.

Figure 2:
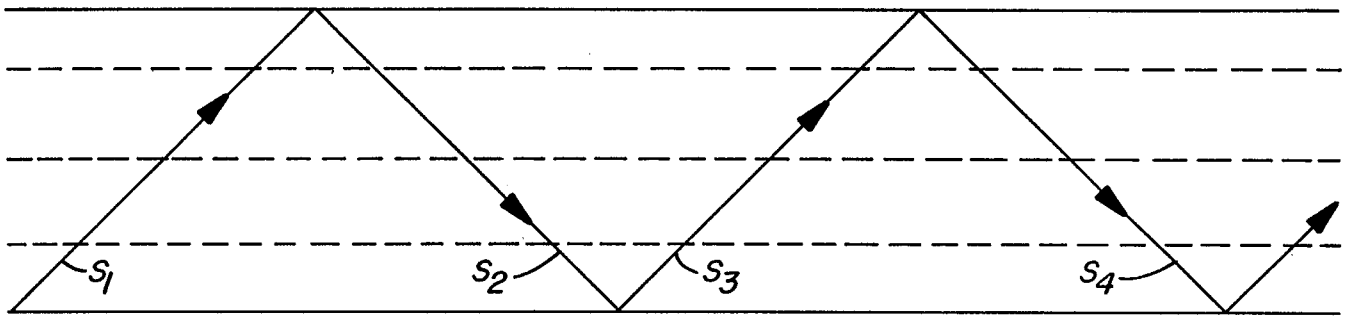
FIG. 2 is a diagram of a typical scanning pattern across a sheet during production.

FIG. 2 shows an example of a typical pattern of scanning paths $S_1$, $S_2$, $S_3$, and so forth which would be traced by a scanning sensor as it traverses the surface of sheet during back-and-forth consecutive scans. It may be appreciated that the angles of each of the scanning paths relative to the true cross-direction depend upon the cross-directional velocity of the scanning sensor and upon the machine-directional velocity of the sheet. In practice, there can be lags between the time a scanning sensor reaches an edge of a sheet and the time at which the return scan begins. Such lags can arise, for example, when the scanner goes off sheet between scans. Finally, with regard to FIG. 2, it should be noted that the scans extend from edge to edge across sheet 18.

In practice, it is typical to calculate an average of profile measurements over each scan. Such averages are often called "last" averages because they are calculated after each scan is completed. Thus, where the scanning rate is about twenty to thirty seconds per scan, last averages are available only about every twenty to thirty seconds. It is common to use last averages as well as cross-directional profile measurements for control purposes.

Figure 3:
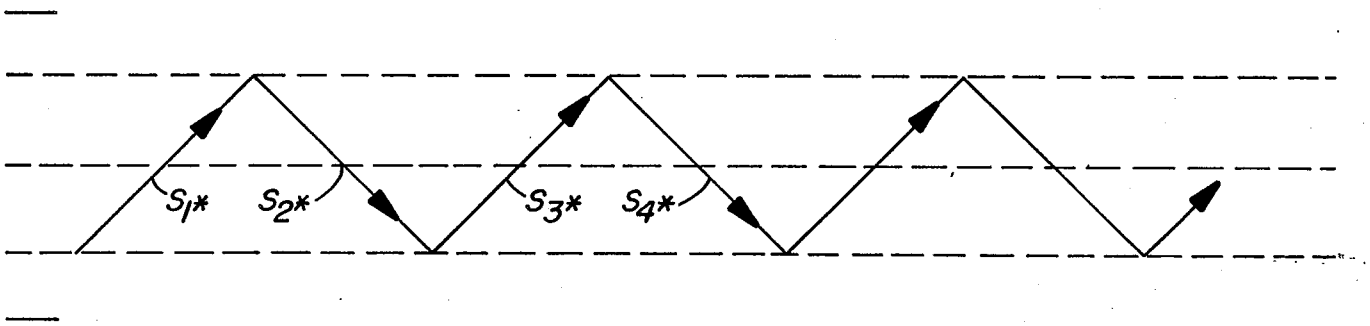
FIG. 3 is a diagram of a scanning pattern according to the present invention.

FIG. 3 shows an example of a pattern of scanning paths $S_1$, $S_2$, $S_3$, and so forth which would be traced by a scanning sensor which is operated according to the present invention. Although the sensor travels across the surface of sheet 18 with back-and-forth consecutive scans, the scans do not extend from edge to edge. Instead, as shown in FIG. 3, the cross-directional width of the zig-zag scanning path is substantially less than the width of sheet 18. In other words, the scanner head is controlled to only a scan portion of the sheet width. In preferred practice, the motor drive is also controlled to operate near its maximum speed during the abbreviated scan periods. Also, it is preferred that the midpoint of each scan is substantially at the centerline of the sheet being scanned; however, this is not necessary.

By operating a scanner with abbreviated scan periods, as shown on FIG. 3, profile measurements can be updated at a rate much faster than normal. For example, with the abbreviated scanning periods, last averages can be obtained with a period of about five seconds. Although the profile measurements obtained in this manner are coarser than usual and may not be exactly representative of sheet properties across the full width of the sheet, the measurements are usually adequate for control purposes during transition times after abrupt process changes have occurred—such as reel changes or sheet breaks or during start-up.

During such transition times, additional steps can also be taken to assure that control signals are rapidly available. For instance, sensor standardization periods can be suspended. Also, the normal sampling rate of the scanning sensor can be decreased. For example, the sampling rate might be decreased from a rate of one sample every fifty milliseconds to a rate of one sample every one hundred or two hundred milliseconds. Such steps have the advantage of reducing the number of calculations involved in calculating cross-directional profiles.

Further in the preferred practice of the present invention, the scan widths are controlled to progressively increase with transition time. For instance, immediately following a process change such as a sheet break or reel change, the scan width could be decreased to fifty percent of sheet width, and thereafter be continuously increased until, at one minute after the transition, the scan width is equal to the sheet width. Also during the transition time, the sampling rate could be increased if it had been decreased below normal at the start of the transition. Likewise, the scanning drive speed could be decreased if it had been increased above normal at the start of the transition.

Although the present invention has been illustrated and described in accordance with a preferred embodiment, it should be recognized that variations and changes may be made therein without departing from the invention as set forth in the following claims.

What is claimed is:

1. A method for controlling a highspeed sheetmaking machine following abrupt process changes and during start-up periods, comprising:

operating a scanning sensor to periodically traverse back and forth across a moving sheet in the cross direction to detect values of a selected sheet property along each scan, said scanning sensor having a normal cross-directional speed and a normal rate at which measurements of the sheet property are made when the scanning sensor traverses the full width of the sheet;

immediately following an abrupt process change or during the start-up periods, controlling the cross-directional width of each scan to be substantially less than the width of the sheet being scanned; and then progressively increasing the cross-directional width of each scan until each of the scans encompass the full width of the moving sheet.

2. The method of claim 1 wherein the midpoint of each scan is not at the centerline of the sheet being scanned.

3. The method of claim 1 wherein the rate at which measurement of a sheet property are made is decreased from its normal rate whenever the cross-directional width of a scan is less than the width of the sheet being scanned.

4. The method of claim 1 wherein the cross-directional speed of the scanning sensor is increased from its normal cross-directional speed whenever the cross-directional width of a scan is less than the width of the heat being scanned.

5. The method of claim 1 wherein the midpoint of each scan is substantially at the centerline of the sheet being scanned.

6. The method of claim 1 including the step of calculating the average of the detected values at the end of each scan.

7. The method of claim 6 wherein the average is calculated without first standardizing the scanning sensor.

* * * * *